US008460008B1

(12) United States Patent
Lin et al.

(10) Patent No.: US 8,460,008 B1
(45) Date of Patent: Jun. 11, 2013

(54) ELECTRICAL CONNECTOR

(75) Inventors: Jui-Pin Lin, New Taipei (TW); Ming-Chun Lai, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/401,596

(22) Filed: Feb. 21, 2012

(51) Int. Cl.
*H01R 11/30* (2006.01)

(52) U.S. Cl.
USPC ..... 439/39

(58) Field of Classification Search
USPC ..... 439/38–40, 700
See application file for complete search history.

(56) References Cited

U.S. PATENT DOCUMENTS

| | | | | |
|---|---|---|---|---|
| 7,311,526 | B2 * | 12/2007 | Rohrbach et al. | 439/39 |
| 7,517,222 | B2 * | 4/2009 | Rohrbach et al. | 439/39 |
| 7,901,216 | B2 * | 3/2011 | Rohrbach et al. | 439/39 |
| 8,083,548 | B1 * | 12/2011 | Lin | 439/607.34 |
| 8,087,939 | B2 * | 1/2012 | Rohrbach et al. | 439/39 |
| 8,152,533 | B1 * | 4/2012 | Lin | 439/39 |
| 8,177,560 | B2 * | 5/2012 | Rohrbach et al. | 439/39 |
| 8,241,043 | B1 * | 8/2012 | Lin | 439/39 |
| 8,388,354 | B1 * | 3/2013 | Lin et al. | 439/39 |
| 2012/0083137 | A1 * | 4/2012 | Rohrbach et al. | 439/39 |
| 2012/0148195 | A1 * | 6/2012 | Umeno | 385/53 |

* cited by examiner

*Primary Examiner* — Ross Gushi
(74) *Attorney, Agent, or Firm* — WPAT, P.C.; Anthony King

(57) ABSTRACT

An electrical connector includes an insulating housing, a plurality of probe pins assembled in the insulating housing, a magnetic block, a metal shell and a piece of mylar. The insulating housing has a base and a tongue extending frontward from a front of the base. The magnetic block is of a unitary block and has an inserting hole penetrating longitudinally therethrough and matching with the tongue. The metal shell is assembled rearward through the tongue to enclose the base, and the magnetic block sheathes the tongue in the inserting hole and abuts against the metal shell. A front end of the tongue further stretches beyond a front surface of the magnetic block. The mylar is sticked on the front surface of the magnetic block and defines a positioning window for positioning the front end of the tongue therein.

6 Claims, 3 Drawing Sheets

ELECTRICAL CONNECTOR

BACKGROUND OF THE INVENTION

1. Field of the Invention

The present invention relates to an electrical connector, and more particularly to an electrical connector adapted for connecting with a mated connector by virtue of magnetic attraction.

2. The Related Art

A traditional electrical connector connected with a mated connector by magnetic attraction generally includes an insulating housing, a plurality of probe pins and a magnetic mechanism assembled in the insulating housing respectively. In use, the interconnection between the electrical connector and the mated connector is apt to be influenced by the magnetic force of the magnetic mechanism. However, the size of the magnetic mechanism often affects the magnetic force of the magnetic mechanism. Moreover, the rapid developments of electronic products call for more stringent requirements to miniaturization of the electrical connector. As a result, the traditional electrical connector generally fails to meet the requirements of both miniaturization and strong magnetic force at the same time.

SUMMARY OF THE INVENTION

Accordingly, an object of the present invention is to provide an electrical connector. The electrical connector includes an insulating housing, a plurality of probe pins, a magnetic block, a metal shell, and a piece of mylar. The insulating housing has a base of substantially rectangular shape and a front of the base extends frontward to form a tongue. The insulating housing defines a plurality of inserting grooves longitudinally penetrating through the base and the tongue. The probe pins are inserted forward in the inserting grooves of the insulating housing respectively. The metal shell is assembled rearward through the tongue to enclose the base. The magnetic block is of a unitary block and has an inserting hole penetrating longitudinally through the magnetic block and matching with the tongue of the insulating housing. The magnetic block sheathes the tongue in the inserting hole and abuts against the metal shell. A front end of the tongue further stretches beyond a front surface of the magnetic block. The mylar has the same shape as that of the magnetic block from a front view. The mylar is sticked on the front surface of the magnetic block and defines a positioning window for positioning the front end of the tongue therein to make the front end of the tongue abreast with a front side of the mylar.

As described above, the insulating housing has the base of substantially rectangular shape and the tongue extending forward from the front of the base and having a smaller dimension than the base. The metal shell is mounted to the insulating housing to enclose the base. The magnetic block is put around the tongue. So, it can effectively make use of the inner space of the electrical connector and is in favor of enlarging the size of the magnetic block so as to reinforce the magnetic attraction between the electrical connector and a mating part, even though it is under the circumstances of no affecting the miniaturization of the electrical connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
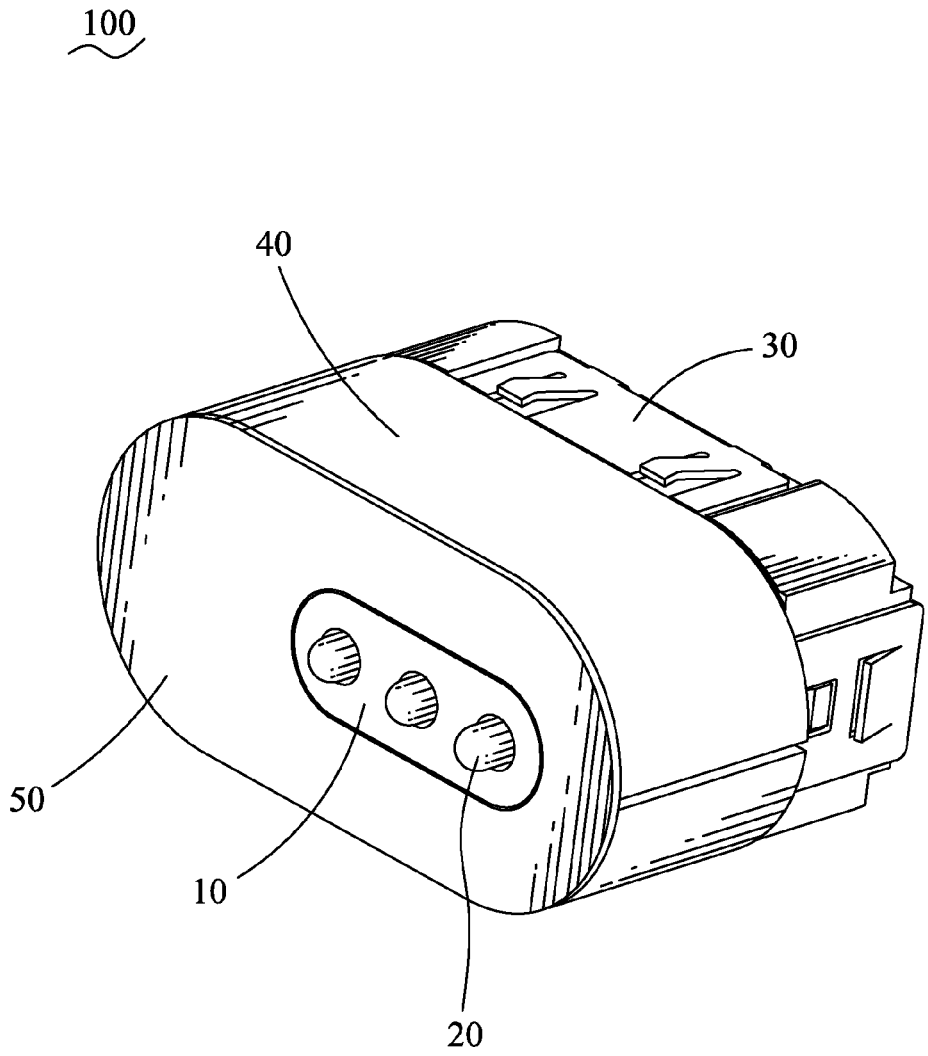
FIG. 1 is an assembled perspective view of an electrical connector according to the present invention.
Figure 2:
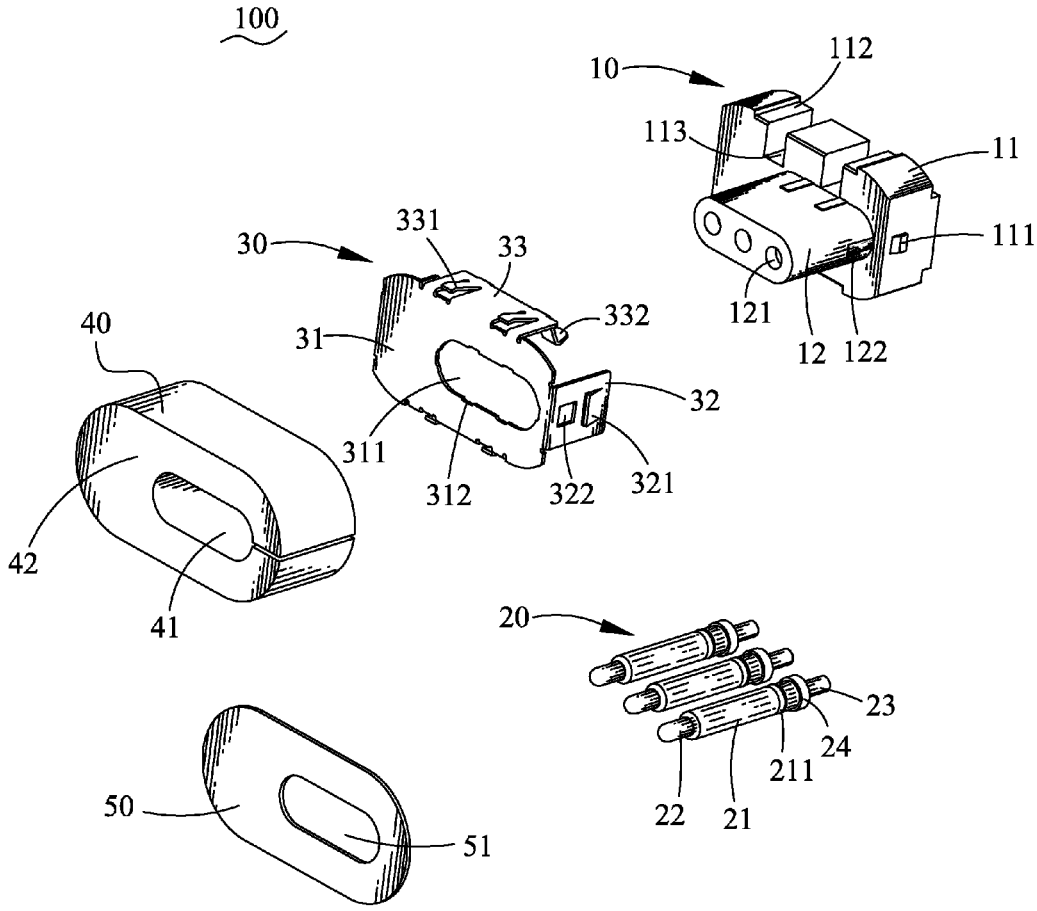
FIG. 2 is an exploded perspective view of the electrical connector shown in FIG. 1.

Referring to the drawings in greater detail, and first to FIGS. 1-2, an embodiment of the invention is embodied in an electrical connector 100. The electrical connector 100 includes an insulating housing 10, a plurality of probe pins 20 assembled in the insulating housing 10, a metal shell 30, a magnetic block 40 and a piece of mylar 50.

Figure 3:
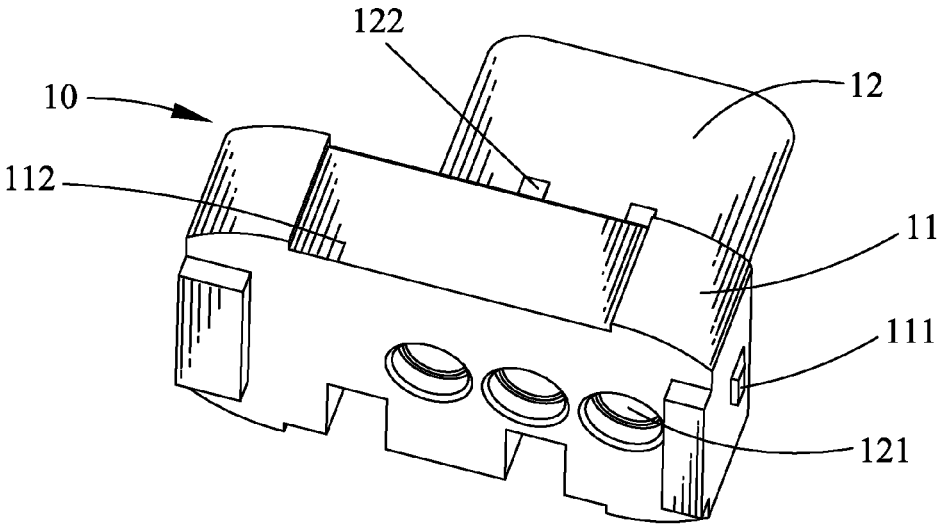
FIG. 3 is a perspective view of an insulating housing of the electrical connector of FIG. 1.
Figure 4:
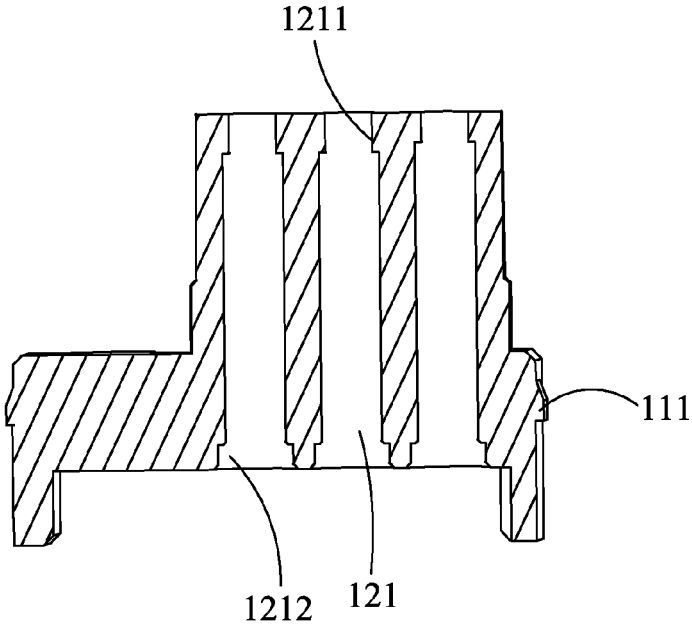
FIG. 4 is a cross-sectional view of the insulating housing of FIG. 3.

With reference to FIGS. 2-4, the insulating housing 10 has a base 11 of substantially rectangular shape. A front of the base 11 extends frontward to form a tongue 12 having a smaller dimension than the base 11. The insulating housing 10 defines a plurality of inserting grooves 121 longitudinally penetrating through the base 11 and the tongue 12. An inner sidewall of the inserting groove 121 has a front portion thereof protruded inward to form a ring-shaped blocking wall 1211, and has a rear portion thereof concaved inward to form a circular blocking groove 1212. A top and a bottom of the base 11 respectively define a fastening fillister 112. A bottom sidewall of the fastening fillister 112 opened in the top of the base 11 is concaved downward to define two receiving fillisters 113 each penetrating longitudinally through the base 11. Two opposite side faces of the base 11 protrude outward to form a buckle block 111 respectively. A periphery outer side of the tongue 12 protrudes outward to form a plurality of fastening ribs 122 spaced from one another and each extending longitudinally to connect the front of the base 11.

Referring to FIG. 2 and FIG. 4, each of the probe pins 20 includes a cylindraceous barrel 21 and a plunger 22 made of metal material. The barrel 21 has a rear end thereof sealed up and a front end thereof opened freely. The plunger 22 is retractably restrained in the barrel 21 by means of an elastic element (not shown) elastically positioned between the plunger 22 and the barrel 21, with a front end thereof stretching outside from the opened front end of the barrel 21. A periphery outside of the barrel 21 protrudes outward to form a ring-shaped blocking portion 24 at the rear end of the barrel 21, and a fastening portion 211 apart from the blocking portion 24 and having a smaller outer diameter than that of the blocking portion 24. The rear end of the barrel 21 extends rearward to form a soldering portion 23. The probe pin 20 is inserted forward in the inserting groove 121 of the insulating housing 10 with the front end of the barrel 21 resisting against a rear of the blocking wall 1211. The blocking portion 24 is positioned in the blocking groove 1212, and the fastening portion 211 abuts against a periphery inner side of the inserting groove 121 to secure the barrel 21 in the inserting groove 121. The plunger 22 retractably stretches forward out of the inserting groove 121 for electrically contacting with a mating part (not shown). The soldering portions 23 project behind the base 11 for being soldered with an external printed circuit board (not shown).

Referring to FIG. 2 and FIG. 3, the metal shell 30 has a front plate 31 with an inserting window 311 opened therein and matching with the tongue 12. A plurality of fastening gaps 312 is apart opened in a periphery inner edge of the inserting window 311. The tongue 12 passes through the inserting window 311 to make the front plate 31 abut against the front of the base 11, and the fastening ribs 122 are snapped in the corresponding fastening gaps 312. Top and bottom edges of the front plate 31 protrude rearward to form a pair of resisting plates 33 clamping the base 11 therebetween. The resisting plate 33 connected with the top edge of the front plate 31 slantwise extends rearward to form two touching slices 332 passing through the corresponding receiving fillisters 113 to stretch behind the base 11. The resisting plates 33 are fastened in the fastening fillisters 112 respectively and each is punched outward to form two elastic slices 331. Two opposite side edges of the front plate 31 extend rearward to form a pair of side plates 32 attached on two opposite side faces of the base 11, and each of the side plates 32 defines a buckle hole 322 buckling the buckle block 111 therein and a locking slice 321 locking the mating part.

Referring to FIG. 1 and FIG. 2, the magnetic block 40 is a unitary block with an inserting hole 41 penetrating longitudinally therethrough and matching with the tongue 12 of the insulating housing 10. In this embodiment, the magnetic block 40 is of a substantial elliptic shape from a front view. The magnetic block 40 sheathes the tongue 12 in the inserting hole 41 to make the front plate 31 of the metal shell 30 clipped between the magnetic block 40 and the base 11. The fastening ribs 122 abut against a periphery inner sidewall of the inserting hole 41 to secure the magnetic block 40 and the tongue 12 together. A front end of the tongue 12 further stretches beyond a front surface 42 of the magnetic block 40.

Referring to FIG. 1 and FIG. 2 again, the mylar 50 has the same shape as that of the magnetic block 40 from a front view. The mylar 50 is sticked on the front surface 42 of the magnetic block 40 and defines a positioning window 51 positioning the front end of the tongue 12 therein to make the front end of the tongue 12 abreast with a front side of the mylar 50. The plungers 22 of the probe pins 20 further retractably stretch forward beyond the front side of the mylar 50.

As described above, the insulating housing 10 has the base 11 of substantially rectangular shape and the tongue 12 extending forward from the front of the base 11 and having a smaller dimension than the base 11. The metal shell 30 is mounted to the insulating housing 10 to enclose the base 11. The magnetic block 40 is put around the tongue 12. So, it can effectively make use of the inner space of the electrical connector 100 and is in favor of enlarging the size of the magnetic block 40 so as to reinforce the magnetic attraction between the electrical connector 100 and the mating part, even though it is under the circumstances of no affecting the miniaturization of the electrical connector 100.

What is claimed is:

1. An electrical connector, comprising:

an insulating housing having a base of substantially rectangular shape, a front of the base extending frontward to form a tongue, the insulating housing defining a plurality of inserting grooves longitudinally penetrating through the base and the tongue;

a plurality of probe pins inserted forward in the inserting grooves of the insulating housing respectively;

a metal shell assembled rearward through the tongue to enclose the base;

a magnetic block of a unitary block having an inserting hole penetrating longitudinally through the magnetic block and matching with the tongue of the insulating housing, the magnetic block sheathing the tongue in the inserting hole and abutting against the metal shell, a front end of the tongue further stretching beyond a front surface of the magnetic block; and a piece of mylar having the same shape as that of the magnetic block from a front view, the mylar being sticked on the front surface of the magnetic block and defining a positioning window positioning the front end of the tongue therein to make the front end of the tongue abreast with a front side of the mylar.

2. The electrical connector as claimed in claim 1, wherein the metal shell has a front plate with an inserting window opened therein and matched with the tongue, the tongue passes through the inserting window to make the front plate abut against the front of the base, top and bottom edges of the front plate protrude rearward to form a pair of resisting plates clamping the base therebetween, two opposite side edges of the front plate extend rearward to form a pair of side plates attached on two opposite side faces of the base.

3. The electrical connector as claimed in claim 2, wherein a top and a bottom of the base respectively define a fastening fillister, a bottom sidewall of the fastening fillister opened in the top of the base is concaved downward to define two receiving fillisters each penetrating longitudinally through the base, the resisting plate connected with the top edge of the front plate slantwise extend rearward to form two touching slices passing through the corresponding receiving fillisters to stretch behind the base, the resisting plates are fastened in the fastening fillisters respectively and each is punched outward to form two elastic slices.

4. The electrical connector as claimed in claim 2, wherein the two opposite side faces of the base protrude outward to form a buckle block respectively, each of the side plates defines a buckle hole buckling the buckle block therein.

5. The electrical connector as claimed in claim 2, wherein a periphery outer side of the tongue protrudes outward to form a plurality of fastening ribs spaced from one another and each extending longitudinally to connect the front of the base, a plurality of fastening gaps is apart opened in a periphery inner edge of the inserting window of the front plate and snaps the corresponding fastening ribs therein, the fastening ribs further interfere with a periphery inner sidewall of the inserting hole to secure the magnetic block around the tongue.

6. The electrical connector as claimed in claim 1, wherein the magnetic block and the mylar are of substantially elliptic shape from the front view.

* * * * *